US006688585B2

(12) United States Patent
Braun et al.

(10) Patent No.: US 6,688,585 B2
(45) Date of Patent: Feb. 10, 2004

(54) CARBURETOR FOR A TWO-CYCLE SCAVENGING ENGINE

(75) Inventors: Matthew A. Braun, Caro, MI (US); Gary J. Burns, Millington, MI (US); Masatoshi Endo, Miyagi-ken (JP)

(73) Assignee: Walbro Engine Management LLC, Cass City, MI (US)

( * ) Notice: Subject to any disclaimer, the term of this patent is extended or adjusted under 35 U.S.C. 154(b) by 0 days.

(21) Appl. No.: 10/156,362

(22) Filed: May 28, 2002

(65) Prior Publication Data

US 2003/0222357 A1 Dec. 4, 2003

(51) Int. Cl.[7] ..... F02M 17/34

(52) U.S. Cl. ..... 261/35; 261/65; 261/DIG. 1; 277/545; 277/547

(58) Field of Search ..... 261/35, 65, DIG. 1; 277/423–425, 545–547, 543

(56) References Cited

U.S. PATENT DOCUMENTS

| | | | | | |
|---|---|---|---|---|---|
| 1,330,381 | A | * | 2/1920 | Marsh | 277/543 |
| 1,982,252 | A | * | 11/1934 | Heggem | 277/543 |
| 2,595,720 | A | * | 5/1952 | Snyder | 261/65 |
| 2,723,867 | A | * | 11/1955 | Howard et al. | 277/543 |
| 3,214,150 | A | * | 10/1965 | Rice | 261/65 |
| 4,153,258 | A | * | 5/1979 | Huber et al. | 277/424 |
| 4,448,425 | A | * | 5/1984 | von Bergen | 277/545 |
| 4,561,158 | A | * | 12/1985 | Johnson et al. | 261/65 |
| 4,616,518 | A | * | 10/1986 | Nusser | 261/65 |
| 4,902,448 | A | * | 2/1990 | Phillips | 261/65 |
| 4,961,355 | A | * | 10/1990 | Irino et al. | 261/65 |
| 5,039,115 | A | * | 8/1991 | Hebert et al. | 277/543 |
| 5,078,111 | A | * | 1/1992 | McCann | 261/65 |
| 5,554,322 | A | * | 9/1996 | Kobayashi | 261/35 |
| 5,611,312 | A | * | 3/1997 | Swanson et al. | 261/52 |
| 6,293,524 | B1 | | 9/2001 | Endo et al. | 261/34.2 |
| 6,328,288 | B1 | | 12/2001 | Gerhardy | 261/35 |

FOREIGN PATENT DOCUMENTS

JP 9-268917 * 10/1997

* cited by examiner

*Primary Examiner*—Richard L. Chiesa
(74) *Attorney, Agent, or Firm*—Reising, Ethington, Barnes, Kisselle, P.C..

(57) ABSTRACT

A carburetor for a scavenged two-stroke internal combustion engine has an enriched fuel-and-air mixing passage extending through a housing of the carburetor. Engaged to the housing is a body of an air flow modular assembly which carries a primary air flow passage which houses a butterfly-type control valve therein. The throttle valve of the fuel-and-air mixing passage is mechanically linked or cammed to the control valve of the air flow passage so that opening of the throttle valve soon after opens the control valve allowing additional air to enter and provide a leaner fuel-and-air ratio in the combustion chamber of the engine when running under load. The air flow modular assembly has a sealing-and-bearing assembly which eliminates air leakage from the surrounding environment along the shaft of the control valve and into the primary air flow passage. The sealing-and-bearing assembly has a bushing which inserts into a counter bore of a cylindrical bore which receives the rotating shaft of the control valve. The bushing is thereby disposed radially and sealingly between the shaft and the body of the modular assembly to journal the shaft and prevent air leakage. To prevent air bypass leakage around the plate of the control valve within the air flow passage, the bushing and respective counter bore do not extend all the way through the body and into the air passage, instead, a cylindrical sealing surface which in-part defines the cylindrical bore, sealingly engages the shaft axially between the counter bore and the air flow passage. In this way, the plate and body interface at the location of the rotating shaft can more exactly follow the contour of the air flow passage, thereby preventing unwanted bypass air flow when the control valve is closed.

25 Claims, 3 Drawing Sheets

CARBURETOR FOR A TWO-CYCLE SCAVENGING ENGINE

FIELD OF THE INVENTION

This invention relates to a carburetor for a two-cycle air scavenging and stratified internal combustion engine and more particularly to a carburetor with a sealing-and-bearing assembly for a butterfly control valve.

BACKGROUND OF THE INVENTION

Carburetors for small two-cycle or two-stroke air scavenged internal combustion engines commonly used for hand held power tools such as chain saws, weed trimmers, leaf blowers and the like are known to have both an enriched fuel-and-air mixing passage and a primary air flow passage which both communicate between a clean air source at atmospheric pressure such as an air filter and a crankcase and combustion chamber respectively of the two-cycle engine. During initial acceleration of the two-cycle engine, a butterfly-type throttle valve within the fuel-and-air mixing passage opens to provide an enriched fuel-and-air mixture to the engine. Toward the end of the acceleration, or after acceleration, a butterfly-type control valve within the primary air flow passage will open permitting clean air to flow through the passage to scavenge exhaust gases from the combustion chamber and provide a relatively leaner mixture of fuel-and-air in the combustion chamber of the running engine. This delay in the opening of the control valve provides a richer mixture of fuel-and-air to enhance acceleration and exhaust scavenging and a leaner mixture to reduce hydro-carbon exhaust emissions during steady state running conditions of the engine. The clean air may also provide a stratified arrangement or layering in the combustion chamber of exhaust gases, fresh air and a fuel-and-air mixture.

Both valves have rotating shafts which are mechanically interlinked or cammed to provide the delayed and synchronized operation of the control and throttle valves. The shaft of the control and throttle valves rotate directly against the body of the carburetor. The clearance between the body and each rotating shaft is slight or small enough to minimize or prevent the ingress or leakage of atmospheric air into the fuel-and-air mixing passage which would otherwise alter the fuel-and-air mixture ratio degrading the operation of the running engine. For two-cycle engine applications, the fuel contained within the enriched fuel-and-air mixture is usually a combination of gasoline and oil, typically mixed at a ratio of 50:1. The oil not only lubricates the moving parts within the crankcase but also lubricates the throttle valve shaft to carburetor body interface.

SUMMARY OF THE INVENTION

A carburetor for a scavenged and stratified two-stroke internal combustion engine which has a fuel-and-air mixing passage and a separate primary or clean air passage with a butterfly-type control valve with a seal and bearing assembly for the actuator shaft of the valve. The valve shaft extends transversely through the primary air passage and is rotatably received in a pair of spaced-apart coaxial cylindrical bores in a body or housing containing the primary air passage and immediately adjacent the air passage with a relatively close fit to at least in part provide an air seal between the shaft and the primary air passage. The valve shaft is also journalled for rotation in a separate bearing or bushing inserted into a counterbore adjacent at least one of the cylindrical bores and terminating short or outboard of the primary air passage to prevent excessive wear of the adjacent cylindrical bore and in part providing seals between the shaft and the body or housing to at least in part prevent air leakage into the primary air flow passage. This seal and bearing configuration also provides a better fit between the closed control valve plate and the air passage to reduce unwanted air flow between them when the control valve is closed.

Preferably, the carburetor has the primary air passage and its associated control valve in one body which in assembly is attached to a separate housing containing the enriched fuel-and-air mixing passage and its associated throttle valve assembly. The control valve of the air flow passage is operably connected with the throttle valve so that when accelerating the engine from idle, the throttle valve initially opens and thereafter the control valve in the air flow passage opens in synchronization with the throttle valve. Preferably, the control valve is operably connected to the throttle valve by a mechanical linkage or cam arrangement.

Preferably, in one form the primary air flow passage and associated control valve are in a separate body attached to one end of a main housing containing the enriched fuel-and-air mixing passage, associated throttle valve, and a pump supplying fuel to a metering chamber. In a second form, the body containing the air flow passage and control valve is attached to the fuel metering side of the main housing of the carburetor. In a third form, the primary air flow body is attached to a fuel pump side of the main housing of the carburetor. Attaching the body of the primary air flow assembly to either the fuel metering side or the fuel pump side of the main housing of the carburetor eliminates the need for a separate cover for the fuel metering system or pump and significantly reduces the size of the carburetor.

It has been discovered that since the rotating shaft of the control valve in the primary air flow passage of the carburetor is not exposed to the enriched fuel-and-air mixture in use it is not lubricated and no capillary seal is provided between the shaft and the body. Thus, without this sealing-and-bearing assembly, the body wears away and galls the rotating shaft of the control valve resulting in seizure and failure, and enlargement of the clearance between them which allows air and damaging contaminates to leak into the primary air flow passage between the worn shaft and body interface, thereby degrading operation of the engine.

Objects, features and advantages of this invention include a sealing-and-bearing assembly which eliminates valve control shaft wear and air ingress into the primary air flow passage along the rotating shaft of the control valve while minimizing clean air flow bypass around the plate of the control valve when closed within the primary air flow passage thereby providing a reliable and smooth running engine which is significantly impervious to dirt and debris. Additional advantages are a reduced number of parts, a reduction in carburetor size, and a design which is easily incorporated into existing carburetors. This design improves engine performance and is relatively simple and economical to manufacture and assemble, and in service has a significantly increased useful life.

BRIEF DESCRIPTION OF THE DRAWINGS

These and other objects, features and advantages of this invention will be apparent from the following detailed description of the preferred embodiments and best mode, appended claims, and accompanied drawings in which:

DETAILED DESCRIPTION OF THE PREFERRED EMBODIMENTS

Figure 1:
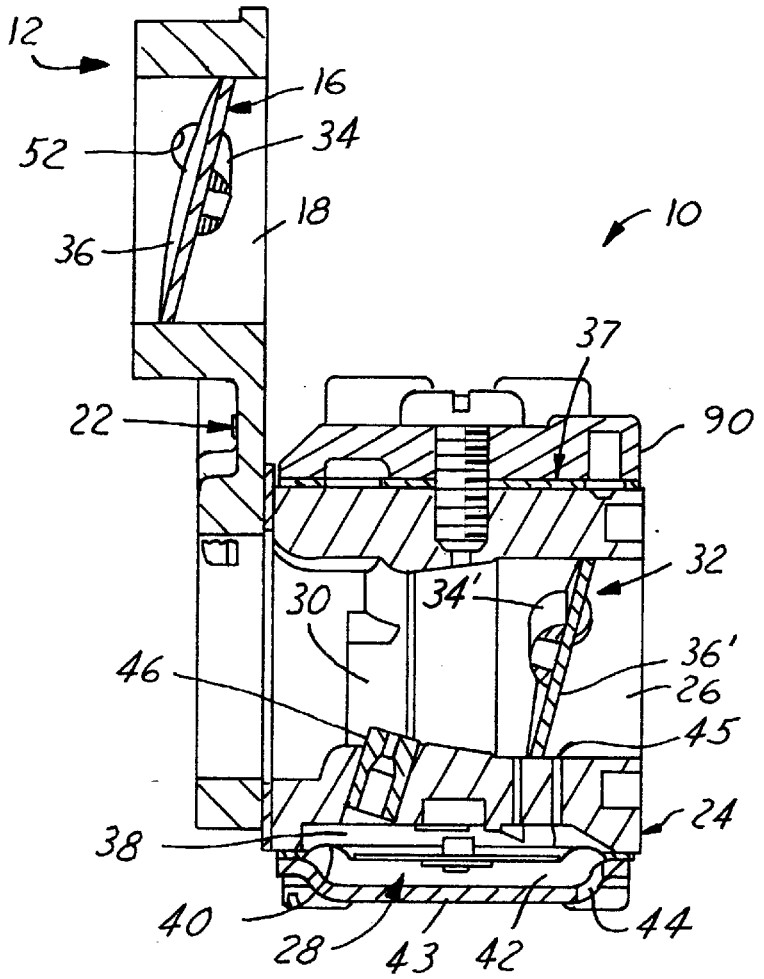
FIG. 1 is a sectional view of a first diaphragm carburetor embodying the invention.

Referring in more detail to the drawings, FIGS. 1–5 illustrate a diaphragm-type carburetor 10 for a stratified and air scavenged two-stroke internal combustion engine having an air flow modular assembly 12 which flows primary air preferably from a clean air source such as an air filter 14 through a butterfly-type control valve 16 disposed in a primary air flow passage 18 and to the combustion chamber of a two-stroke engine 20. A body 22 of the air flow modular assembly 12 is attached to one end of a main housing 24 of the diaphragm carburetor 10 which has an enriched fuel-and-air mixing passage 26.

In use, fuel is supplied through a high speed or main fuel feed nozzle 46 of a fuel metering system 28 into the fuel-and-air mixing passage 26 near a venturi 30 defined by the housing 24 and mixes with air flowing through the passage 26. The fuel-and-air mixture flows past a butterfly-type throttle valve 32 disposed downstream of the venturi 30 of the fuel-and-air mixing passage 26 and into the crankcase of the two-stroke engine 20.

The control valve 16 operates within the primary air flow passage 18, and the throttle valve 32 operates within the mixing passage 26. Each valve 16, 32 has a rotating shaft 34, 34' engaged to a pivoting valve plate 36, 36' which when closed conforms to the contour of the respective passages 18, 26. Synchronized operation of the control valve 16 with the throttle valve 32 provides smooth acceleration and steady-state running conditions of the engine 20. Commonly, during acceleration of the engine, the throttle valve 32 is first to open and is followed by the opening of the control valve 16 after a short delay. This initially provides an enriched fuel-and-air mixture necessary for the acceleration period which later somewhat leans out for smooth steady state running conditions. To provide this opening sequence, the valve shafts 34 and 34' are operably connected such as by a mechanical linkage or cam linkage (not shown). One such linkage is described in U.S. Pat. No. 6,328,288 B1, inventor Gerhardy, issued Dec. 11, 2001, the disclosure of which is incorporated herein by reference.

Fuel is supplied to the fuel metering system 28 by a fuel pump assembly 37 similar to the pump assembly described in U.S. Pat. No. 6,293,524 B1, inventor Endo, issued Sep. 25, 2001, the disclosure of which is incorporated herein by reference. Fuel flows from the fuel pump assembly 37 into a fuel metering chamber 38 of the fuel metering system 28 through a valve 39 opened and closed by flexing or displacement of a diaphragm 40. The fuel metering chamber 38 is defined substantially between a first side of the diaphragm 40 and the carburetor housing 24 and an air reference chamber 42, typically at or near atmospheric pressure, is defined between an opposite side of the diaphragm 40 and a cover plate 43 attached by machine screws to the housing. The air reference chamber 42 communicates with the atmosphere via an air channel or port 44 in the cover plate 43. In use, when the operating engine is idling (and the throttle valve 32 is substantially closed), fuel is supplied from the metering chamber 28 to the mixing passage 26 through idle or low speed ports 45, and when the throttle valve 32 is substantially opened (and thus the engine is operating at high speed and/or load conditions), fuel is supplied to the mixing passage 26 primarily through the main or high speed fuel nozzle 46.

For two-cycle engine applications, the fuel is typically a mixture of gasoline and oil at a 50:1 ratio. The oil contained with the fuel flowing through the enriched fuel-and-air mixing passage 26 not only serves to lubricate the moving parts within the crankcase of the engine 20 but also provides lubrication for the interface between the rotating shaft 34' of the throttle valve 32 and the main housing 24 of the carburetor 10. The clearance between this interface is minimal, should remain constant and in use the contacting moving surfaces must not wear in order to prevent air leakage from the surrounding external environment of the carburetor, along the rotating shaft 34' of the throttle valve 32, and into the downstream side of the fuel-and-air mixing passage 26, which in use is at a vacuum. Should air leakage occur, the fuel to air mixture ratio would be altered causing rough engine running conditions along with the ingress of dirt and other contaminates which would be harmful to the engine. Accentuating lubrication is the phenomena of fuel spit-back from the crankcase, back into the downstream side or outlet portion of the fuel-and-air mixing passage 26 providing further lubrication for the rotating shaft 34' and housing 24 interface.

Figure 2:
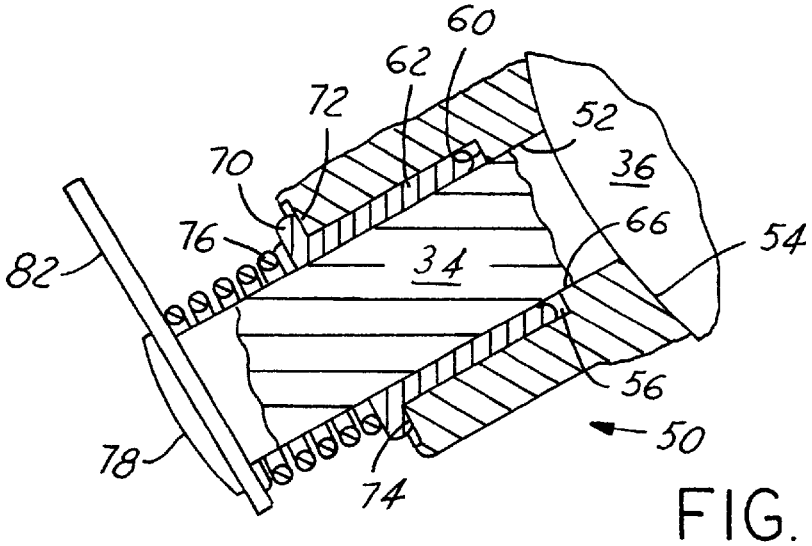
FIG. 2 is a fragmentary enlarged sectional view of the sealing-and-bearing assembly of FIG. 1.
Figure 3:
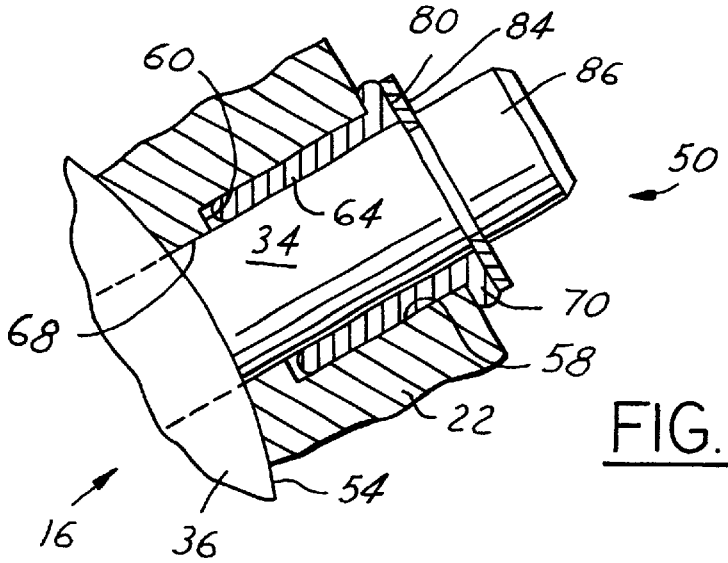
FIG. 3 is a fragmentary enlarged sectional view of the sealing-and-bearing assembly of FIG. 1.
Figure 4:
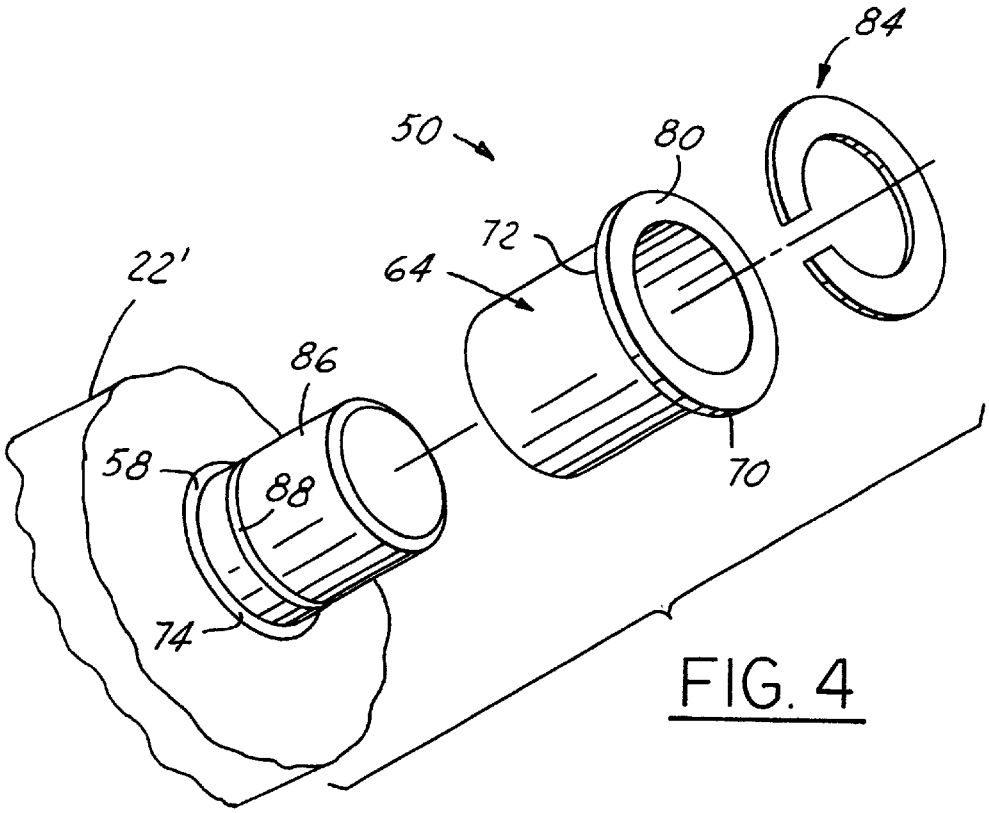
FIG. 4 is a fragmentary exploded perspective view of the sealing-and-bearing assembly of FIG. 3.

Because fuel and oil does not flow through the primary air flow passage 18, lubrication of the interface between the rotating shaft 34 of the control valve 16 and the body 22 of the air flow modular assembly 12 is not available. Therefore, the sealing-and-bearing assembly of this invention insures that wear and galling of this interface does not occur and air ingress or leakage is prevented. As best illustrated in FIGS. 1–3, a sealing-and-bearing assembly 50 prevents air leakage along the rotating shaft 34 of the control valve 16 adjacent to the body 22 and also prevents clean air bypass around the closed plate 36 of the control valve 16 along the flow passage 18. The shaft 34 of the control valve 16 extends laterally and completely through the body 22 of the air flow modular assembly 12 and preferably across the axial center of the primary air flow passage 18. The shaft 34 seats rotatably within a cylindrical bore 52 through the body 22. Preferably, the valve plate 36 is attached substantially at the axial center of the rotating shaft 34 and thereby pivots open and closed within the air flow passage 18. The perimeter or circumferential edge 54 of the plate 36 follows the internal contours of the air flow passage 18 so that when the plate 36 pivots closed via the rotating shaft 34 the air flow passage 18 is substantially blocked. Any clean air bypass around the peripheral or circumferential edge 54 of the valve plate 36 is minimized or eliminated via the close tolerance between the edge 54 and the internal walls of the passage 18 carried by the body 22 and between the edge 54 and the shaft 34. In other words, the edge 54 is directly adjacent to the internal walls of the body 22 and its associated shaft 34, and not the internal ends of bushings 62, 64 which could lead toward unwanted clean air bypass.

The cylindrical bore 52, at either end, has diametrically opposed first and second counter bores 56, 58 which extend toward one another into the body 22 but stop short of the air flow passage 18. An annular shelf or shoulder 60 in the body 32 formed at the bottom of each counterbore 56, 58 is preferably spaced slightly from the ends of the respective bushings 62, 64. Seated sealably within each counter bore is the respective first and second bushing 62, 64 which are thus disposed radially between the rotating shaft 34 and the body 22. To prevent clean air flow bypass around the circumferential edge 54 of the plate 36, as previously described, the counter bores 56, 58 do not extend all the way into or communicate with the air flow passage 18 but stop short thereof. Instead, cylindrical first and second sealing surfaces 66, 68 are disposed axially with respect to the shaft 34 and between the respective first and second counter bores 56, 58 and the air flow passage 18 or valve plate 36 of the control valve 16. The surfaces 66, 68 provide a smooth contour or transition between the body 22 and the circumferential edge 54 of the plate 36 thus minimizing clean air bypass flow around the plate 36. If the bottom of the bushings 62, 64 were exposed to the air flow passage 18, the smooth transition would not exist and unwanted air flow bypass would occur.

The first and second bushings 62, 64 are substantially identical, each having an annular shoulder 70 which projects radially outward from the annular portion of the bushing to engage externally the body 22 and axially locate the bushings 62, 64 within the respective counter bores 56, 58. The shoulder 70 has an inward annular surface 72 which preferably engages an exterior annular seat 74 carried by the body 22 encircling each counter bore 56, 58. Biasing inward and holding the bushings 62, 64 within their respective counter bores 56, 58 is a coiled compression spring 76 disposed concentrically about a first end portion 78 of the shaft 34 of the control valve 16 which projects axially outward from an external annular surface 80 of the shoulder 70 of the first bushing 62. The spring 76 is compressed directly between the external annular surface 80 of the shoulder 70 and a control arm 82 attached to and projecting laterally outward from the first end portion 78 of the shaft 34. The arm 82 is connected to a cam or linkage mechanism operated by the throttle valve 32 to provide a lost motion coupling and synchronous movement of the shaft 34 and valve plate 36 in response to the opening movement of the throttle valve 36' in the fuel and air mixing passage 26.

In assembly the shaft 34 is retained in the body 22 and the bushings by a retaining ring or clip 84 which snaps onto an opposite second end portion 86 of the shaft 34 projecting axially outward from the external annular surface 80 of the shoulder 70 of the second bushing 64. Preferably, the ring 84 snaps into a circumferential groove 88 in the second end portion 86 and aligned substantially axially flush with the external annular surface 80 of the second bushing 64 so that the force exerted by the spring 76 biases the retaining ring 84 axially against the surface 80.

The first and second bushings 62, 64 are made of a self-lubricating or substantially frictionless material such as plastic material. Preferably, the bushings 62, 64 are made of an acetal resin such as DELRIN® or a polyamide such as Nylon™ both available from E. I. Dupont deNemours Co. Other suitable plastic materials are believed to be polyethylene and polyurethane plastic materials. The contact of the ring 84 with the shoulder 70 of the second bushing 64 is thus substantially frictionless allowing the ring 84 to revolve with the rotating shaft 34. The radial contact of the first and second bushings 62, 64 along the axial length of the shaft 34 is also substantially frictionless and provides both a sealing interface and a lateral bearing interface which further preserves and in use prevents wear of the metal-to-metal interface and contact of the first and second sealing surfaces 66, 68 of the body 22 with the rotating shaft 34.

Figure 5:
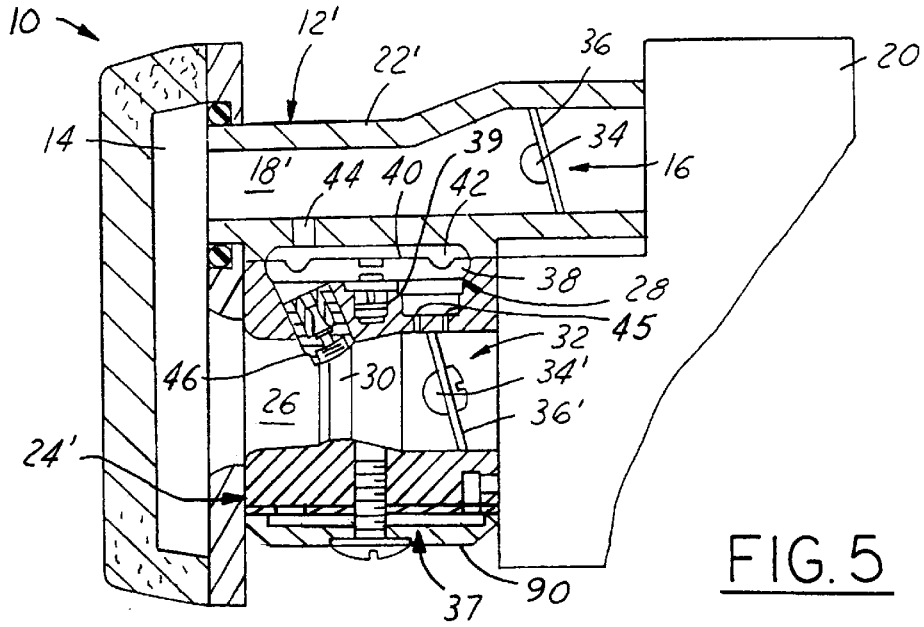
FIG. 5 is a sectional view of a second diaphragm carburetor embodying the invention.

FIG. 5 illustrates a second diaphragm carburetor 10' with an air flow modular assembly 12' with a control valve 16 in an air flow passage 18' in a body 22' mounted on the fuel metering side of the main housing 24' of the carburetor. A cavity in the body 22' cooperates with the diaphragm 40 to define the air chamber 42 of the fuel metering system 28, thereby eliminating the need for a separate cover plate such as the cover plate 43 of the first carburetor 10. Clean air is supplied to both of the passages 18 and 26 through an air filter 14 communicating with the inlets of both passages of the carburetor. The carburetor 10' is shown mounted on a two-stroke engine 20 with the fuel-and-air mixing passage 26 communicating with the engine crankcase and the primary air flow passage 18 communicating with the engine combustion chamber.

Figure 6:
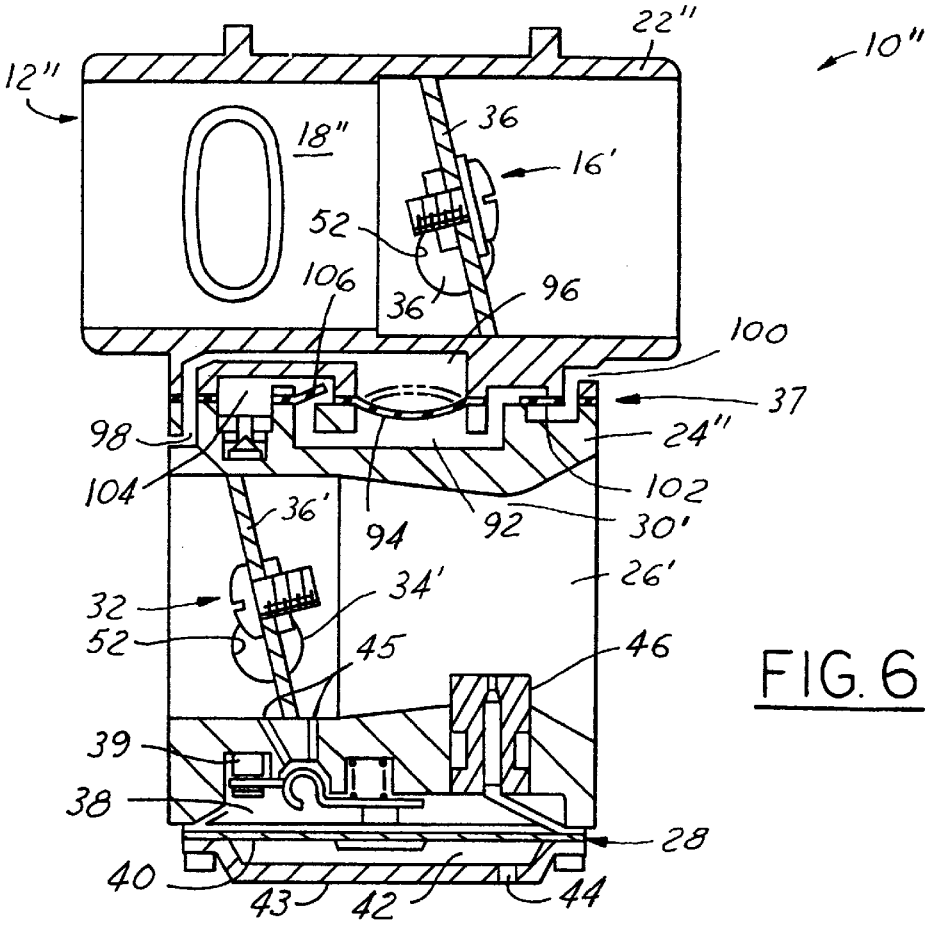
FIG. 6 is a sectional view of a third diaphragm carburetor embodying the invention.

FIG. 6 illustrates a third diaphragm carburetor 10" with an air flow modular assembly 12" mounted on the fuel pump side of the main carburetor body 24" which eliminates the need for a separate cover plate such as the cover plate 90 of carburetor 10'. The fuel pump assembly 37 is received between a body 22" of the air flow assembly 12" and the main housing 24" of the carburetor which defines a fuel-and-air mixing passage 26' with a throttle valve 32 therein. Fuel is delivered from a fuel pump chamber 92 via a flexing or pulsating diaphragm or membrane 94 of the pump assembly 37 to a fuel metering system 28' engaged to the bottom of the housing 24". The fuel pump chamber 92 is substantially defined between the housing 24" and the flexible membrane 94.

To displace the membrane 94 and pump the fuel, a pulse chamber 96 of the pump 37 is defined between an opposite side of the membrane 94 and the body 22". A pulse passage 98 defined substantially by the body 22" communicates between the pulse chamber 96 and the crankcase of a running engine to deliver the pulsating pressure fluctuations which displace the membrane 94 from its unflexed position. A fuel inlet passage 100 defined between the body 22" and housing 24" supplies fuel to the pump chamber 92 from a remote fuel tank and through a one-way check valve 102 disposed between the body 22" and housing 24" within the passage 100. A fuel outlet passage 104 defined between the body 22" and housing 24" supplies fuel from the pump chamber 92 into the fuel metering chamber 38 of the fuel metering system 28. A one-way check valve 106 shown in an open position is received between the body 22" and housing 24" within the fuel outlet passage 104.

While the forms of the invention herein disclosed constitute presently preferred embodiments, many others are possible. It is not intended herein to mention all the possible equivalent forms or ramifications of the invention. It is further understood that the terms used herein are merely descriptive rather than limiting, in that various changes may be made without departing from the spirit and scope of this invention as defined by the following claims.

What is claimed is:

1. A sealing-and-bearing assembly for a butterfly valve of a carburetor having a body and a flow passage carried by the body communicating between an air source at near atmospheric pressure and a stratified scavenging two-stroke combustion engine, wherein the butterfly valve has a plate disposed pivotally within the air passage and a rotatable shaft which is engaged to the plate and extends transversely through the air passage, the sealing-and-bearing assembly comprising:

the body having a first counter bore extending into the body, wherein the shaft of the butterfly valve extends through the first counter bore; and a first bushing disposed sealably within the first counter bore and radially between the body of the carburetor and the rotating shaft for preventing air leakage through the first counter bore along the shaft and into the air passage.

2. The sealing-and-bearing assembly set forth in claim 1 comprising:

a first sealing face of the body defining a cylindrical bore disposed concentrically to the first counter bore and communicating between the first counter bore and the flow passage; and wherein the shaft is disposed axially and concentrically along the cylindrical bore between the flow passage and the first counter bore and is in direct sealing contact with the first sealing face of the body for preventing air bypass about the plate and along the flow passage when the butterfly valve is closed.

3. The sealing-and-bearing assembly set forth in claim 2 comprising:

an exterior annular seat carried by the body; and a shoulder of the first bushing extending radially and concentrically outward from one end of the first bushing and being disposed externally to the body, the shoulder being engaged to the annular seat for axially locating the first bushing within the first counter bore.

4. The sealing-and-bearing assembly set forth in claim 3 comprising a spring disposed concentrically about the shaft projecting from the carburetor body and shoulder of the first bushing, wherein the spring is compressed axially to bias the shoulder of the first bushing against the annular seat of the body.

5. The sealing-and-bearing assembly set forth in claim 1 wherein the shaft is disposed concentrically to the bushing and the bushing is disposed concentrically within the counter bore.

6. A sealing-and-bearing assembly for a butterfly valve of a carburetor having a body and a flow passage carried by the body communicating between an air source at near atmospheric pressure and a stratified scavenging two-stroke combustion engine, wherein the butterfly valve has a plate disposed pivotally within the air passage and a rotatable shaft which is enraged to the plate and extends transversely through the air passage, the sealing-and-bearing assembly comprising:

the body having a first counter bore extending into the body, wherein the shaft of the butterfly valve extends through the first counter bore;

a first bushing disposed sealably within the first counter bore and radially between the body of the carburetor and the rotating shaft for preventing air leakage through the first counter bore alone the shaft and into the air passage;

a first sealing face of the body defining a cylindrical bore disposed concentrically to the first counter bore and communicating between the first counter bore and the flow passage;

wherein the shaft is disposed axially and concentrically along the cylindrical bore between the flow passage and the first counter bore and is in direct sealing contact with the first sealing face of the body for preventing air bypass about the plate and alone the flow passage when the butterfly valve is closed;

an exterior annular seat carried by the body;

a shoulder of the first bushing extending radially outward from one end of the first bushing and being disposed externally to the body, the shoulder being engaged to the annular seat for axially locating the first bushing within the first counter bore;

a spring disposed concentrically about the shaft projecting from the carburetor body and shoulder of the first bushing, wherein the spring is compressed axially to bias the shoulder of the first bushing against the annular seat of the body;

wherein the cylindrical bore traverses the flow passage and extends through the carburetor body;

a second counter bore being diametrically opposed to the first counter bore with respect to the flow passage;

a second bushing disposed within the second counter bore; and wherein the shaft extends through the body within the cylindrical bore and through the second bushing.

7. The sealing-and-bearing assembly set forth in claim 6 comprising the shaft having a second end portion projecting outward from the second bushing; and a retaining ring press fitted to the second end portion, wherein the retaining ring holds the second bushing within the second counter bore and is biased against the second bushing by the axial force of the spring.

8. The sealing-and-bearing assembly set forth in claim 7 wherein the second bushing has a shoulder projecting radially outward and engaged axially between the retaining ring and the carburetor body for providing a substantially frictionless interface between the shoulder of the second bushing and the retaining ring when the retaining ring rotates in unison with the rotating shaft.

9. The sealing-and-bearing assembly set forth in claim 8 comprising:

a second sealing face of the body defining in-part the cylindrical bore communicating between the second counter bore and the flow passage; and wherein the shaft disposed axially between the second counter bore and the flow passage is in direct sealing contact with the second sealing face of the body for preventing flow bypass about the plate and along the flow passage when the throttle valve is closed.

10. The sealing-and-bearing assembly set forth in claim 9 wherein the first bushing is identical to the second bushing and the first counter bore is identical to the second counter bore.

11. The sealing-and-bearing assembly set forth in claim 10 wherein the carburetor is a diaphragm-type.

12. The sealing-and-bearing assembly set forth in claim 11 comprising:

the flow passage being a primary air passage;

the butterfly valve being a control valve;

a housing of the diaphragm-type carburetor engaged to the body, wherein the housing carries an enriched fuel-and-air mixing passage communicating between the clean air source at near atmospheric pressure and the combustion engine; and a throttle valve disposed within the fuel-and-air mixing passage and linked mechanically with the control valve.

13. The sealing-and-bearing assembly set forth in claim 12 comprising a fuel metering system having a fuel metering chamber, a diaphragm and an atmospheric air reference chamber, wherein the fuel metering chamber is defined between a side of the diaphragm and the housing, and the air reference chamber is defined between an opposite side of the diaphragm and the body.

14. The sealing-and-bearing assembly set forth in claim 13 comprising:

an air channel carried by the body and communicating between the air reference chamber of the fuel metering system and the air passage upstream of the control valve.

15. The sealing-and-bearing assembly set forth in claim 14 wherein the first and second bushings are plastic.

16. The sealing-and-bearing assembly set forth in claim 12 comprising a fuel pump assembly having a fuel pump chamber, a pulse chamber and a flexible membrane, wherein the fuel pump chamber is defined between a side of the flexible membrane and the housing, and the pulse chamber is defined directly between an opposite side of the flexible membrane and the body.

17. The sealing-and-bearing assembly set forth in claim 16 comprising:

a passage of the fuel pump assembly carried by the body and housing and communicating between the pulse chamber and a crankcase of the two-stroke engine;

a fuel inlet passage of the fuel pump assembly carried by the body and housing for flowing fuel into the fuel pump chamber through a one-way check valve disposed between the body and the housing; and a fuel outlet passage of the fuel pump assembly carried by the body and housing for flowing pressurized fuel from the fuel pump chamber, through a second one-way check valve disposed between the body and the housing, and to a fuel metering system carried by the housing.

18. An air flow modular assembly for a diaphragm-type carburetor of a stratified scavenging two-stroke combustion engine having a housing, a fuel-and-air mixing passage extending through the housing, a throttle valve disposed within the mixing passage, a fuel metering system for delivering fuel to the mixing passage upstream of the throttle valve and a fuel pump assembly for delivering fuel to the fuel metering system, the air flow modular assembly comprising:

a body engaged to the housing of the diaphragm-type carburetor;

an air passage defined by the body for flowing air from an air source, through the body, and to the combustion engine;

a cylindrical bore carried by the body and communicating transversely with the air passage and extending through the body;

a control valve disposed within the air passage, the control valve having a rotating shaft extending laterally through the air passage within a cylindrical bore; and a sealing-and-bearing assembly having:

a first counter bore to the cylindrical bore, the first counter bore extending into the body, a first bushing disposed sealably within the first counter bore and radially between the body of the carburetor and the rotating shaft for preventing air leakage through the first counter bore along the shaft and into the air passage, a second counter bore extending into the body and being opposed diametrically to the first counter bore with respect to the air passage, and a second bushing disposed within the second counter bore, wherein the shaft extends through the body within the cylindrical bore and through the second bushing.

19. The air flow modular assembly set forth in claim 18 wherein the fuel metering system has a diaphragm, a fuel metering chamber defined between the diaphragm and the housing, and an atmospheric air reference chamber defined between the body and the diaphragm.

20. The air flow modular assembly set forth in claim 19 wherein the first and second bushings each having a radially outwardly projecting shoulder disposed outwardly from the body for axially locating the first and second bushings within the respective first and second counter bores.

21. The air flow modular assembly set forth in claim 20 comprising:

the control valve being a butterfly-type valve having a plate engaged to the shaft with the air passage;

a first sealing face of the body defining in-part the cylindrical bore and disposed between the air passage and the first counter bore; and a second sealing face of the body defining in-part the cylindrical bore and disposed between the air passage and the first counter bore, wherein the shaft is in direct sealing contact with the first and second sealing faces for preventing air bypass about the plate and along the air passage when the butterfly valve is closed.

22. The air flow modular assembly set forth in claim 21 comprising:

a control arm of the butterfly control valve projecting laterally outward from an end of the shaft projecting outward from the shoulder of the first bushing; and a spring disposed concentrically about the shaft and compressed axially between the shoulder of the first bushing and the control arm of the control valve to bias the shoulder of the first bushing against the body.

23. The air flow modular assembly set forth in claim 22 comprising a retaining ring press fitted to the shaft projecting outward from the shoulder of the second bushing, wherein the spring biases the retaining ring against the shoulder of the second bushing and thus biases the shoulder of the second bushing against the body.

24. The air flow modular assembly set forth in claim 23 wherein the control arm of the control valve is mechanically linked to the throttle valve.

25. The air flow modular assembly set forth in claim 18 wherein the fuel pump assembly has a flexible membrane, fuel pump chamber defined between a side of the flexible membrane and the housing, and a pulse chamber defined between an opposite side of the flexible membrane and the body.

* * * * *

UNITED STATES PATENT AND TRADEMARK OFFICE

CERTIFICATE OF CORRECTION

PATENT NO. : 6,688,585 B2
DATED : February 10, 2004
INVENTOR(S) : Matthew W. Braun et al.

It is certified that error appears in the above-identified patent and that said Letters Patent is hereby corrected as shown below:

Column 7,
Lines 49 and 59, delete "alone" and insert -- along --.

Signed and Sealed this

Sixth Day of July, 2004

JON W. DUDAS
*Acting Director of the United States Patent and Trademark Office*